US009216439B2

(12) United States Patent
Le Blanc

(10) Patent No.: US 9,216,439 B2
(45) Date of Patent: Dec. 22, 2015

(54) ROTARY BRUSH ATTACHMENT

(76) Inventor: Joseph Roger Le Blanc, Georgetown (CA)

( * ) Notice: Subject to any disclaimer, the term of this patent is extended or adjusted under 35 U.S.C. 154(b) by 81 days.

(21) Appl. No.: 12/831,646

(22) Filed: Jul. 7, 2010

(65) Prior Publication Data

US 2011/0005012 A1 Jan. 13, 2011

Related U.S. Application Data

(60) Provisional application No. 61/223,842, filed on Jul. 8, 2009.

(51) Int. Cl.

| | |
|---|---|
| ***A46B 9/02*** | (2006.01) |
| ***B08B 1/04*** | (2006.01) |
| ***A46B 13/00*** | (2006.01) |
| ***A46B 13/02*** | (2006.01) |
| ***B24B 9/00*** | (2006.01) |
| ***B24D 13/10*** | (2006.01) |
| *A46B 7/10* | (2006.01) |
| *A46B 7/08* | (2006.01) |
| *A46B 7/04* | (2006.01) |

(52) U.S. Cl.

CPC ..... *B08B 1/04* (2013.01); *A46B 13/001* (2013.01); *A46B 13/02* (2013.01); *B24B 9/00* (2013.01); *B24D 13/10* (2013.01); *A46B 7/042* (2013.01); *A46B 7/08* (2013.01); *A46B 7/10* (2013.01); *A46B 9/02* (2013.01); *A46B 2200/3073* (2013.01); *A46B 2200/3093* (2013.01)

(58) Field of Classification Search

CPC ..... A46B 7/10; A46B 7/08; A46B 7/042; A46B 9/02; A46B 2200/3073; B08B 1/04

USPC ..... 15/88, 104.04, 160, 179, 104.03, 159.1, 15/197, 198

See application file for complete search history.

(56) References Cited

U.S. PATENT DOCUMENTS

| | | | | |
|---|---|---|---|---|
| 2,629,121 A * | 2/1953 | Petre | ..... | 15/104.03 |
| 3,188,674 A | 6/1965 | Hobbs | | |
| 4,301,567 A * | 11/1981 | Tucker | ..... | 15/160 |

(Continued)

FOREIGN PATENT DOCUMENTS

| | | |
|---|---|---|
| GB | 2147835 | 5/1985 |
| NL | 1010783 | 6/2000 |

OTHER PUBLICATIONS

Superior Car Care, Product Information for Wurth Wheel Hub Cleaning Combo, downloaded from http://superiorcarcare.net/wurth-wheel-hub-cleaning-combo.html, Jul. 31, 2008.

(Continued)

*Primary Examiner* — Chi Q Nguyen

(74) *Attorney, Agent, or Firm* — Gowling Lafleur Henderson LLP; Jeffrey W. Wong

(57) ABSTRACT

A rotary brush attachment for use with a tool, such as a power tool, to remove rust, paint, debris, and other unwanted matter accumulated on the surface of fasteners and other parts used in construction, automotive applications, and industrial applications. The rotary brush attachment comprises a body oriented along a longitudinal axis, an engagement portion for removably engaging a tool, and a brush portion. The brush portion comprises a hollow extending at least partially into the body along the longitudinal axis, and bristles extending from the interior surface of the hollow towards the longitudinal axis.

7 Claims, 5 Drawing Sheets

(56) References Cited

U.S. PATENT DOCUMENTS

| | | | | |
|---|---|---|---|---|
| 4,862,549 | A * | 9/1989 | Criswell et al. | 15/104.04 |
| 5,168,660 | A * | 12/1992 | Smith | 451/462 |
| 5,269,104 | A * | 12/1993 | DiBiagio | 451/344 |
| 6,553,601 | B1 | 4/2003 | Major | |
| 6,745,425 | B1 * | 6/2004 | Tope | 15/104.04 |
| 6,745,426 | B1 * | 6/2004 | Knowles | 15/104.04 |
| 6,964,077 | B2 * | 11/2005 | Kadinger et al. | 15/104.03 |
| 6,983,508 | B2 * | 1/2006 | Saurer | 15/104.04 |
| 7,356,867 | B1 * | 4/2008 | Beiermann | 15/23 |
| 7,434,289 | B2 * | 10/2008 | Sumiyoshi et al. | 15/179 |
| 7,993,309 | B2 * | 8/2011 | Schweikert | 604/267 |
| 8,032,970 | B2 * | 10/2011 | Chen | 15/160 |
| 8,613,642 | B2 * | 12/2013 | Bowles et al. | 451/51 |
| 2004/0031112 | A1 * | 2/2004 | Saurer | 15/88 |
| 2004/0200018 | A1 * | 10/2004 | Kadinger et al. | 15/104.04 |
| 2004/0226576 | A1 * | 11/2004 | Hambalek | 134/6 |
| 2004/0255414 | A1 * | 12/2004 | Tulipana | 15/104.04 |
| 2006/0112506 | A1 | 6/2006 | Smart et al. | |

OTHER PUBLICATIONS

European Patent Office, Extended European Search Report for Patent Appln No. 1100114, Apr. 22, 2013.

* cited by examiner

ROTARY BRUSH ATTACHMENT

CROSS-REFERENCE TO RELATED APPLICATIONS

The present application claims the benefit of U.S. Provisional Patent Application No. 61/223,842, filed Jul. 8, 2009, which is incorporated herein by reference.

FIELD OF THE DISCLOSURE

The present disclosure relates generally to power tool attachments. More particularly, the present disclosure relates to a rotary brush attachment adapted for use with a power tool.

BACKGROUND OF THE DISCLOSURE

Fasteners and other parts used in construction, automotive applications, and industrial applications often accumulate debris such as dirt, corrosion, paint, and other wanted matter on their surface over time due to their exposure to the elements. For example, trucks and trailers with steel wheels are often fastened with longer studs that are typically used for aluminum wheels. The longer studs offer the advantage of accommodating the possible future use of aluminum wheels. However, the excess length of the stud protrudes beyond the lug nut and can accumulate rust and debris. Likewise, studs used in construction and industrial applications can accumulate corrosion, paint and other unwanted debris. If left uncleaned, the accumulated debris can cause damage to the fasteners and tools during maintenance and repair operations. For example, using an air wrench to remove a fastened nut from an uncleaned stud can cause the debris to become impacted in the thread causing the nut to grind the thread and potentially damaging the air wrench.

Currently, the use of wire brushes to remove debris from fasteners and other parts is known in the art. However, this approach can be time-consuming, labor-intensive or may be ineffective in removing particularly stubborn debris.

It is, therefore, desirable to provide an improved means for quickly and effectively removing unwanted accumulation debris on fasteners and other parts.

SUMMARY OF THE DISCLOSURE

In one aspect there is provided a rotary brush attachment comprising: a body oriented along a longitudinal axis; an engagement portion for removably attaching the body to a tool; and a brush portion. The brush portion comprises a hollow extending along the longitudinal axis at least partially into the body, and bristles extending from the hollow toward the longitudinal axis.

In operation, the rotary brush attachment is attached to a power tool and rotated about its longitudinal axis by the action of the power tool. The rotating engagement of the bristles with the part to be cleaned removes unwanted accumulations from the surface of the part.

In another aspect there is provided a rotary brush assembly a brush insert, a socket casing, and a cap. The socket casing includes a body oriented along a longitudinal axis, a socket recess in the body, an engagement portion for removably attaching the body to a tool and a casing thread. The brush insert includes a brush insert body having a hollow, and bristles extending away from the surface of the hollow. The cap includes a cap body having a cap hole, and a threaded rim for cooperating with the casing thread. The brush insert body fittingly corresponds to the socket recess, the brush insert is secured in the socket recess by screwing the cap to the socket casing.

Other aspects and features of the present disclosure will become apparent to those ordinarily skilled in the art upon review of the following description of specific embodiments of the disclosure in conjunction with the accompanying figures.

BRIEF DESCRIPTION OF THE DRAWINGS

Embodiments of the present disclosure will now be described, by way of example only, with reference to the attached Figures, wherein.

DETAILED DESCRIPTION

Generally, the present disclosure provides a rotary brush attachment for removing debris such as rust, or other unwanted matter from the surface of a fastener, such as a stud, or other part. The rotary brush attachment finds particular application in the automotive industry for cleaning tire studs, but can also be used for fasteners or other parts where debris may collect over time such as in construction, industrial machinery, and other applications.

Figure 1:
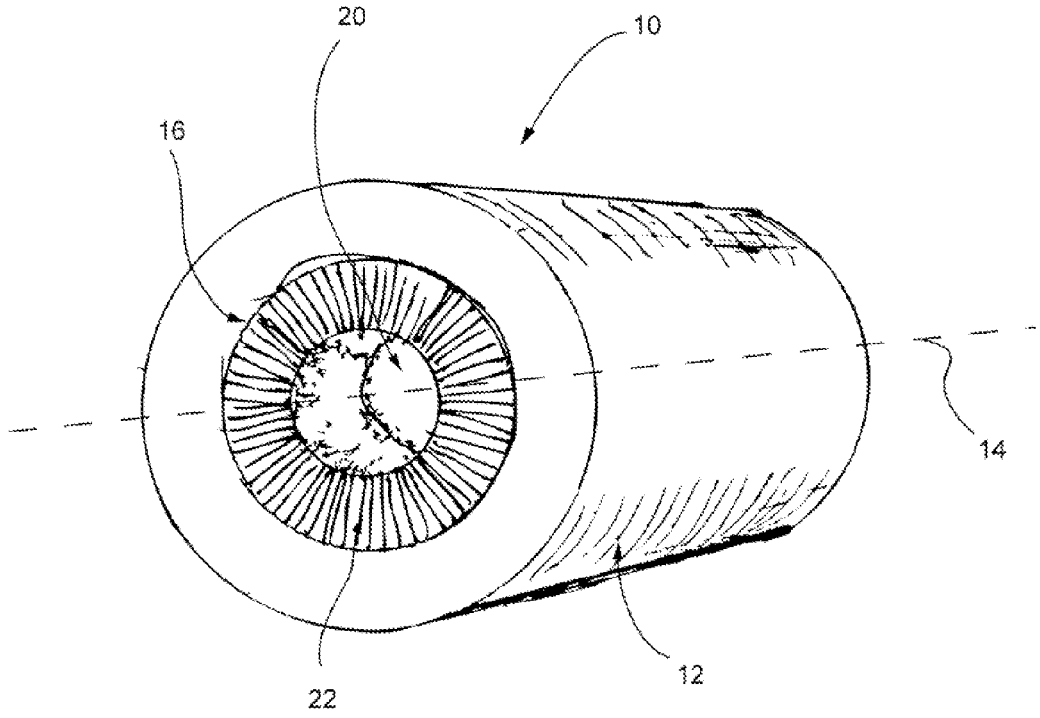
FIG. 1 is a perspective view showing the brush portion of an embodiment the rotary brush attachment.
Figure 2:
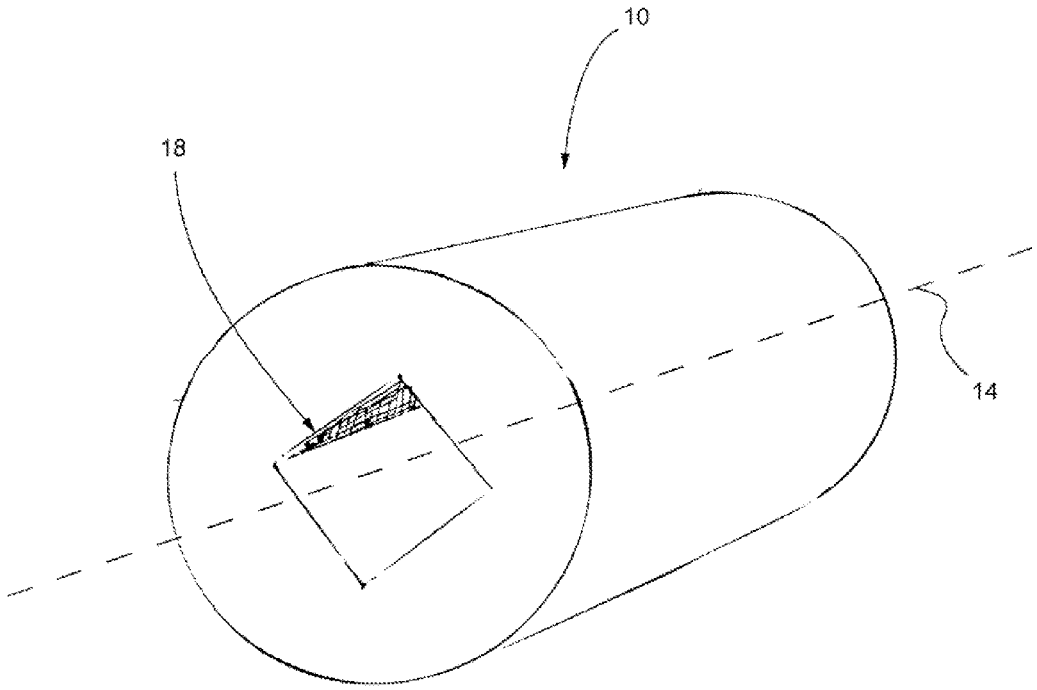
FIG. 2 is a perspective view showing the engagement portion of an embodiment of the rotary brush attachment.

FIGS. 1 and 2 are perspective end views of a first embodiment of a rotary brush attachment 10. The rotary brush attachment 10 includes a body 12 having a longitudinal axis 14 with a brush portion 16 at one end (FIG. 1), and an engagement portion 18 at an opposite end (FIG. 2) for attaching the brush attachment to a power tool (not shown) such as a rotary tool, an air wrench, a power drill or the like. In the preferred embodiment, the body 12 is formed of a resilient material, such as steel, which is suitable for use with the power tool and to handle the torque and other pressures applied by the power tool during the cleaning of the fastener.

The end with the brush portion 16 includes an opening or hollow portion 20 that extends at least partially into the body 12 along the longitudinal axis 14 where a set of bristles 22 general extending from the surface of the hollow portion 20 toward the centre of the body 12. The shape of the hollow 20 and the profile of the bristles 22 are adapted to facilitate cleaning of the part, such as the fastener.

The material used for the bristles 22 is chosen according to the intensity of cleaning required and the material and finish of the part to be cleaned. For example, a rotary brush attachment having wire bristles may be used for a fastener made of a very durable material and covered with significant corrosion and resilient debris while a brush attachment with soft nylon bristles may be used for a relatively fragile part with a delicate finish. In some cases, the bristles 24 may include a heterogeneous mixture of bristles made of different materials.

Referring to FIG. 2, engagement portion 18 engages a power tool to allow the rotary brush attachment 10 to provide the necessary torque or rotation to be applied to the brush attachment 10 for cleaning the part. In the preferred embodiment, the brush attachment can be removably attached to the power tool and is adapted to engage the retaining means of a standard power tool. Once the brush attachment has been attached to the power tool, the power tool may be activated to rotate the rotary brush attachment 10 about its longitudinal axis 14. The brush portion 16 can then be placed over the part to be cleaned and the rotary brush attachment 10 advanced so that the bristles 22 surround the part to be cleaned, and the rotation of the bristles 22 around the part allows the part to be cleaned by removing the unwanted debris.

In one particular embodiment, the rotary brush attachment body 12 is generally cylindrical while the bristles 22 are formed from a resilient wire, and the shape of the hollow portion 20 and the profile of the bristles 22 are adapted for the cleaning of automotive fasteners, such as studs. The engagement portion 18 is sized to quickly connect to and be disconnected from a standard ½ inch, ¾ inch, or 1 inch drive of a power tool.

Figure 3:
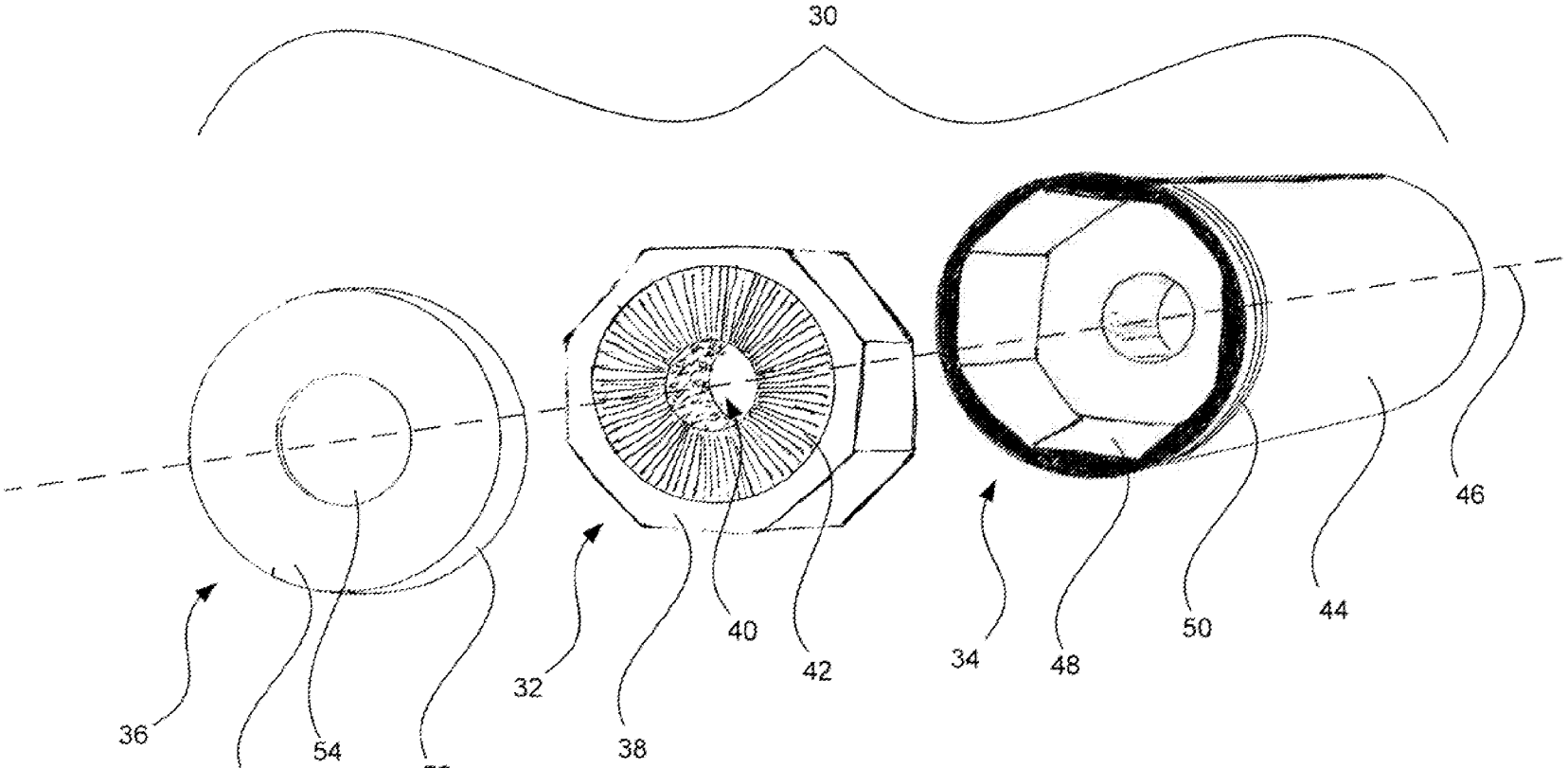
FIG. 3 is an exploded perspective view showing an alternative embodiment of the rotary brush attachment.

FIG. 3 is an exploded perspective view of another embodiment of a rotary brush assembly. The rotary brush attachment assembly 30 includes a brush insert portion 32, a socket casing 34 and a cap portion 36. The brush insert portion 32 includes a brush insert body 38, a hollow portion 40 extending at least partially into the brush insert body 38 A set of bristles 42 extend from the surface of the hollow portion 40 toward the middle of the brush insert portion 32. Socket casing 34 comprises a body 44 oriented along a longitudinal axis 46, a socket recess 48 in body 44, and a casing thread 50. An engagement portion (not shown) is located at the end of the socket casing 34 away from the socket recess 48 for engaging a retaining means of a power tool.

The brush insert body 38 and the socket recess 44 fittingly correspond to each other so that the body 38 fits within the recess 44. Although an octagonal profile is shown, other cross-sectional profiles are contemplated, such as, but not limited to, square, pentagonal, hexagonal, heptagonal, or the like. Standardizing the dimensions of the cross-sectional profiles of the brush insert body 38 and the socket recess 44 enables interchangeability between brush inserts portions 32 and socket casings 34.

Cap portion 36 comprises a cap body 52 with a cap hole portion 54 in the cap body 52, and a threaded rim 56 for cooperating with the casing thread 50 of the socket casing 34. In one embodiment, threaded rim 56 can be screwably mounted to casing thread 50 to secure the brush insert portion 32 within the socket casing 34. Once a brush insert portion 32 has been placed in socket casing 34, the part may be cleaned by the bristles 42 whereby the part is inserted into the assembly 30 via the cap hole 54. It will be understood that other suitable means can be used to secure cap portion 36 to socket casing 34.

Brush insert portion 32 may be removed from the socket casing 34 by unscrewing the cap portion 36 from the socket casing 34 thereby providing access to subsequently remove brush insert portion 32 from socket recess 34. This arrangement enables convenient and flexible swapping of brush insert portions 32 and socket casings 34, facilitating the use of several specialized brush insert portions 32 with a particular socket casing 34, replacement of a brush insert portion 32 with worn-out bristles 42 or the use of a particular brush insert portion 32 with different socket casings 34. For example, a set of brush insert portions 32 having specialized bristles 42 could be combined with a set of socket casings 34, each adapted for a different power tool, to enable the use of any of the specialized brush insert portions 32 with any power tool.

Figure 4:
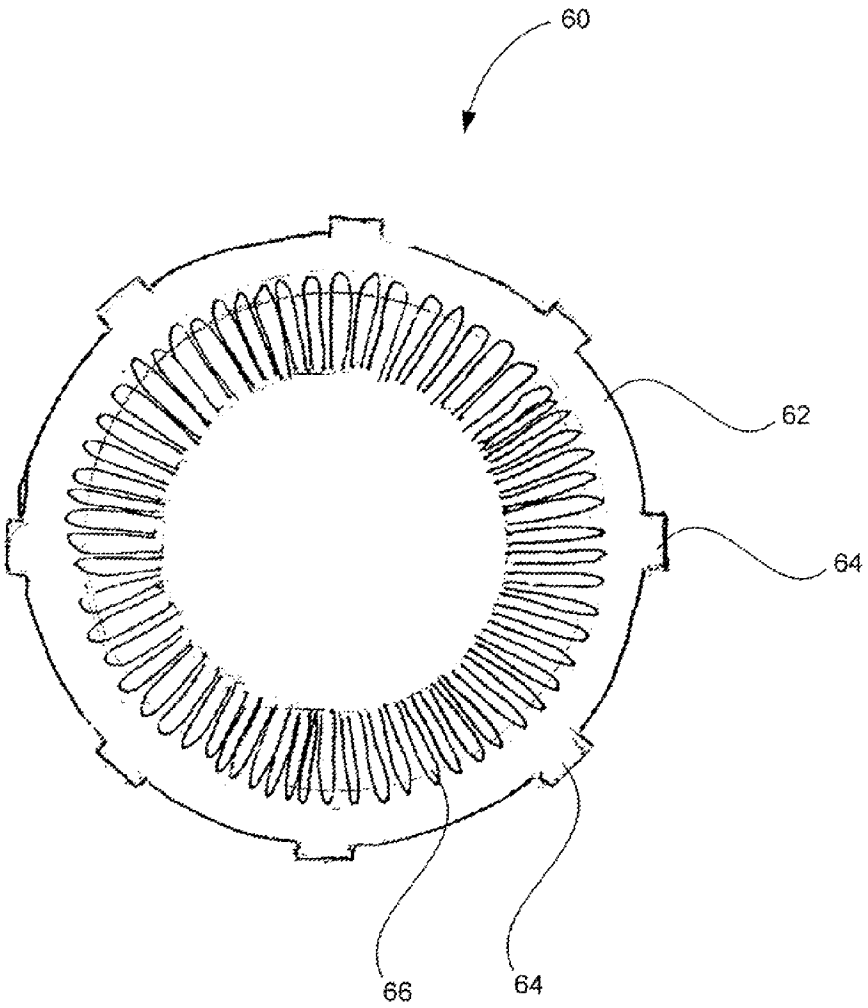
FIG. 4 is a front view of a second embodiment of a rotary tool brush attachment.
Figure 5:
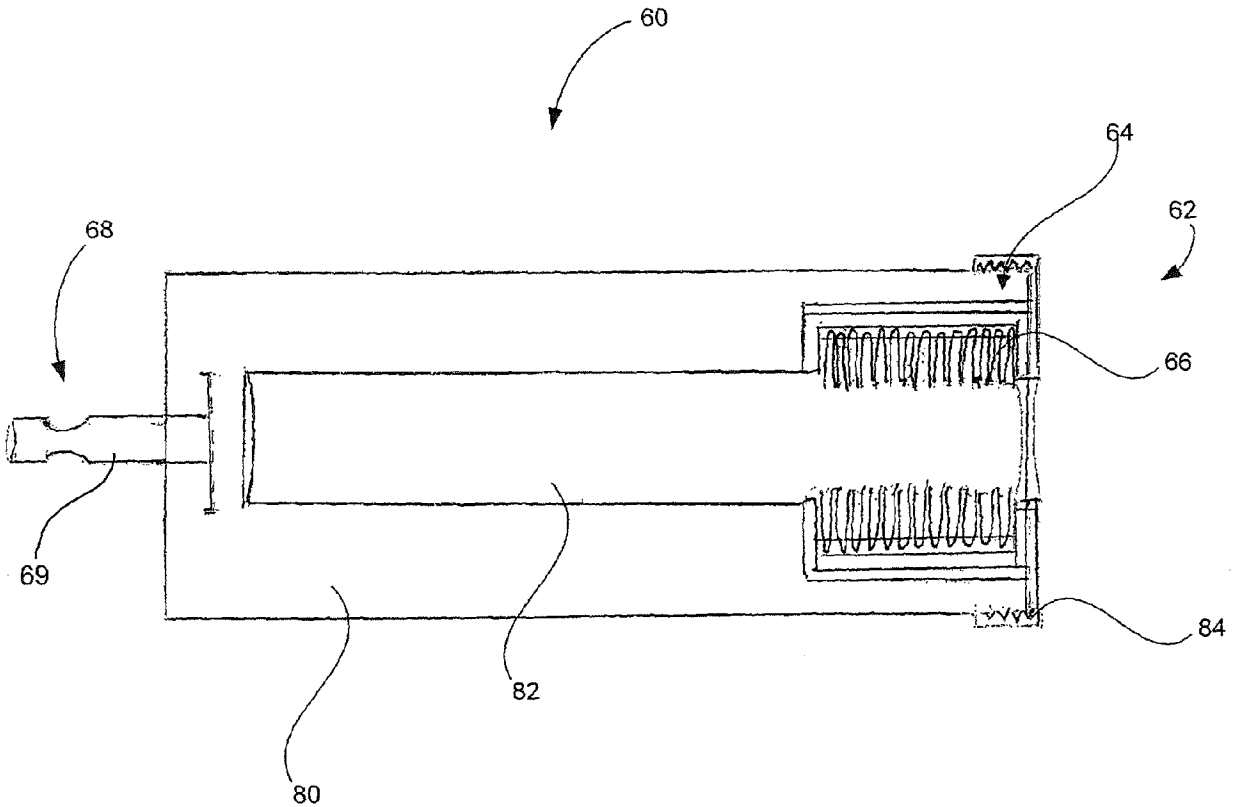
FIG. 5 is a cut away view of the rotary tool brush attachment of FIG. 4.

Turning to FIGS. 4 and 5, a further embodiment of a rotary bush attachment is shown. In this embodiment, the rotary brush attachment includes a replaceable steel brush cartridge. FIG. 4 provides a front view of the rotary brush attachment while FIG. 5 provides a cut-away view of the brush attachment. The rotary brush attachment 60 includes a brush portion end 62 having a set of protrusions 64 located around a circumference of the brush portion end 62. The brush portion end 62 also includes a set of bristles 66 located on an inner circumference of the brush portion end 62 with the ends of the bristles 66 defining a space whereby a part to be cleaned can be inserted. In one embodiment, the space has a diameter of about 15 mm in order to accommodate a ¾ inch stud while a diameter of about 12 mm may be used to accommodate a ⅝ inch stud.

Turning to FIG. 5, further details of the rotary brush attachment 60 can be seen. Opposite the brush portion end 62 is an engagement portion end 68 which includes a quick connect mechanism 69 for attachment with a power tool, such as an air wrench. In this embodiment, the attachment 60 includes a body portion 80, preferably made of steel or carbon fiber, which acts as a housing for a steel brush cartridge 82. In one embodiment, the steel brush cartridge is integrated within the housing and in another embodiment, the cartridge is replaceable. In FIG. 5, the cartridge 82 is replaceable. After the cartridge 82 is inserted into the body portion 80, a cap 84 may be connected to the body portion 80 such as via a threaded connection. Alternatively, the cap may also be connected via a set of snaps or locking grooves.

The above-described embodiments of the disclosure are intended to be examples only. Alterations, modifications and variations can be effected to the particular embodiments by those of skill in the art without departing from the scope of the disclosure, which is defined solely by the claims appended hereto.

What is claimed is:

1. A rotary brush attachment for cleaning a stud comprising:

an elongated steel brush cartridge including a brush end portion, the brush end portion for receiving the stud;

a body portion for housing the elongated steel brush cartridge, the body portion also including an engagement portion end having a connecting mechanism for attachment to a power tool; and a cap for holding the elongated steel brush cartridge in place;

wherein the elongated steel brush cartridge has an inner diameter smaller than an inner diameter of the brush end portion and larger than an inner diameter of a brush insert cartridge;

wherein the connecting mechanism includes a quick connect mechanism for connecting the rotary brush attachment to the power tool thereby resulting in the rotary brush attachment being mounted to the power tool; and wherein the cap is located at said brush end portion of the elongated steel brush cartridge.

2. The rotary brush attachment of claim 1 wherein the elongated steel brush cartridge is replaceable.

3. The rotary brush attachment of claim 1 wherein the cap is connected to the body portion via a threaded connection.

4. The rotary brush attachment of claim 1 wherein the cap is connected to the body portion via a set of snaps.

5. The rotary brush attachment of claim 1 wherein the cap is connected to the body portion via a set of locking grooves.

6. The rotary brush attachment of claim 1 wherein the brush end portion comprises a set of bristles.

7. The rotary brush attachment of claim 6 wherein the set of bristles are made from either steel or nylon.

* * * * *